United States Patent [19]

Goldstein et al.

[11] 4,177,407

[45] Dec. 4, 1979

[54] ELECTRONIC VOTIVE LIGHTS

[75] Inventors: Harold Goldstein, Westbury; William T. Montren, Bayshore, both of N.Y.

[73] Assignee: Control Electronics Co., Inc., Farmingdale, N.Y.

[21] Appl. No.: 849,650

[22] Filed: Nov. 8, 1977

[51] Int. Cl.[2] ..... H05B 37/00; H05B 39/00; H05B 41/00

[52] U.S. Cl. ..... 315/312; 315/360; 307/141; 361/195

[58] Field of Search ..... 315/312, 313, 360; 340/309.1; 307/141; 361/195, 196, 202

[56] References Cited

U.S. PATENT DOCUMENTS

| | | | |
|---|---|---|---|
| 3,767,937 | 10/1973 | Schmidgall | 307/141 X |
| 3,973,140 | 8/1976 | Phillips | 361/196 |
| 4,058,752 | 11/1977 | Woods et al. | 315/360 |

*Primary Examiner*—Eugene R. LaRoche
*Assistant Examiner*—Robert E. Wise
*Attorney, Agent, or Firm*—Fleit & Jacobson

[57] ABSTRACT

Electronically timed and electrically operated lamps are utilized in place of traditional candles. Actuation of a switch, located on each lamp holder, illuminates that lamp for an accurately timed predetermined period. One clock is utilized to drive a plurality of independent timers, each associated with an individual lamp. The lamp units are provided with the capability of being plugged into the timing unit, so as to permit interchangability.

9 Claims, 8 Drawing Figures

ELECTRONIC VOTIVE LIGHTS

BACKGROUND OF THE INVENTION

The present invention relates to electronically timed and electrically operated votive lights and, more specifically, to an electronic circuit which permits individual lamp units to be illuminated for a predetermined period of time.

Candles have been used in religious ceremonies since long before the advent of Christianity. These candles have taken various forms and one popular form is the votive candle which is usually placed inside a red glass holder and is generally displayed in the sanctuary in rows on racks. Such votive candles are then individually lit in order to signify the offering of prayers or special intentions. These votive candles have been a very traditional manner of indicating such special intentions and, typically, the intention is accompanied by a donation or contribution and the candle then burns until it is exhausted. Such candles may be chosen to remain lit for various periods but the conventional or traditional periods are either four hours or seven days.

Although these candles are a tradition in many churches and denominations, they provide serious fire hazards, since the candles remain lit overnight when the church is essentially unattended. Moreover, the open flames of the candles will tend to provide smoke which not only adversely affects the air quality in the church but often times provides an unpleasant odor. Also, because the candles are conventional paraffine or beeswax candles, the burning wick will release considerable amounts of soot and lampblack into the air, which tends to soil the walls and the interior of the church, thereby increasing the normal cleaning and maintenance requirements. While these disadvantages may seem minimal, it should be noted that very often hundreds of such candles are arrayed at the front of the church and the small contribution by each candle then becomes magnified accordingly.

Although the use of the votive candles involve all of the above mentioned drawbacks, it would never be seriously considered to eliminate the use of votive lights, since they form such an important part of many traditional church ceremonies.

SUMMARY OF THE INVENTION

The present invention provides an electronic circuit for causing electric lamps to be illuminated for predetermined periods of time. The electric lamps are intended to be placed inside replicas of the traditional candle holders so as to make it essentially impossible to distinguish between an actual burning candle and the lamp which is electrically illuminated. Each lamp is provided with an individual switch for activating that particular lamp. A specialized electronic timing circuit is provided in conjunction with each individual lamp such that the lamp will remain illuminated for a preselected period of time and upon the completion of such time period, the lamp will be subsequently extinguished. The present invention is completely safe, since there are no fire hazards caused by flames or the like. The inventive votive lights are configured and arranged so as to be identical to the votive candle array which is presently in use.

The electronic timing circuit operates utilizing a single driver clock and each individual lamp assembly has associated with it a timing circuit, which operates such that once the switch is pressed the appropriate light will stay illuminated for a desired period of time.

Additionally, the present invention provides an electronic timing circuit having a plurality of conventional octal sockets which mate with plugs located on the individual lamp units, such that the units may be changed at will to facilitate bulb replacement and also to convert one electronic timing unit which is arranged for use with a seven day lamp assembly to a four hour lamp assembly which utilizes the smaller type lamp units.

Accordingly, it is an object of the present invention to provide a religious votive light which does not utilize candles.

It is another object of the present invention to provide an electronic timing circuit to accurately control the period of illumination of such votive lights.

It is a still further object of the present invention to provide an electronically timed, electrically operated lamps for use as votive lights and which are each individually energizable and each individually timed so as to function as separate individual units.

It is another object of the present invention to provide an electronic timing circuit for use with electric votive lamps such that the timing circuit is extremely compact and employs solid state devices so as to require a minimum of power.

Finally, it is an object of the present invention to provide an electronically timed, electrically operable votive light array which is essentially undetectable from the conventional, traditional votive candle array.

The manner in which the present invention achieves these and other objects will become evident from the following detailed description of an embodiment of the present invention.

DETAILED DESCRIPTION OF THE PREFERRED EMBODIMENT

Figure 1:
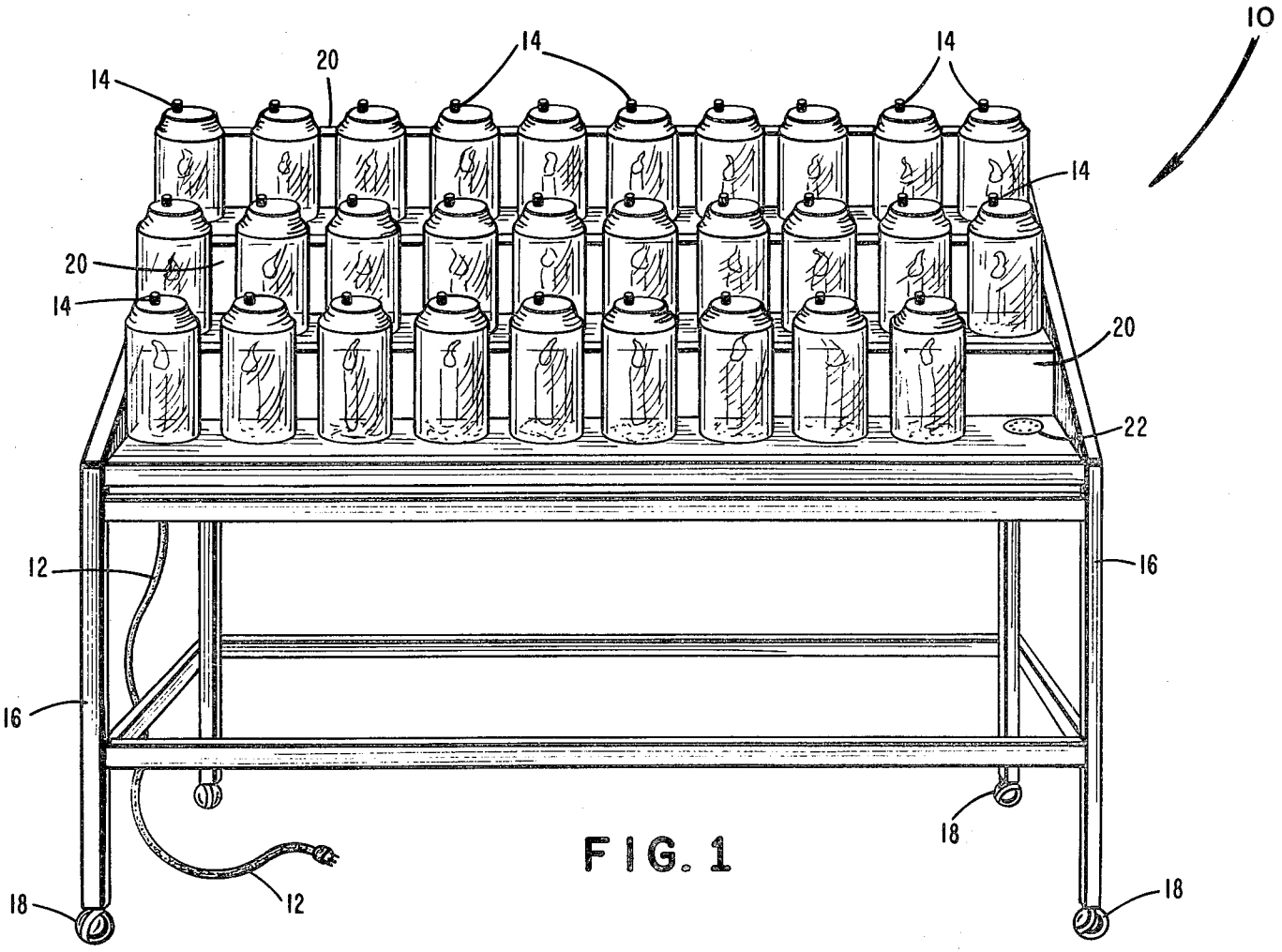
FIG. 1 is a perspective view of an array of the inventive electrically operated votive lights.

FIG. 1 shows the inventive votive light array 10 and, as may be seen, such array appears identical to the traditional array utilizing votive candles in place of electric lamps. The noticeable differences between the inventive array 10 of FIG. 1 and the conventional or traditional candles might be that there is provided an electrical cord and plug 12 and also that each of the individual candle holders or lamp holders has protruding from the top, a switch actuation button, shown typically at 14.

The individual candle holders are arranged in rows and mounted on a framework 16, which may be formed of aluminum and may be gold anodized so as to present an esthetically pleasing appearance. Moreover, the framework 16 may be mounted on castors or rollers, shown typically at 18, to provide a movable or portable array which will facilitate cleaning and/or relocation. The framework 16 is provided with housings 20 which extend from side to side in the framework 16, each of which is associated with a row of lamps. In these housings 20, is located the electronic timing circuit provided by the present invention. The view of FIG. 1 shows one of the invention lamp assemblies having been unplugged from the array and, accordingly, the empty socket 22 is seen. It is understood, of course, that each of the inventive votive lamps is plugged into a socket identical to socket 22.

Figure 2:
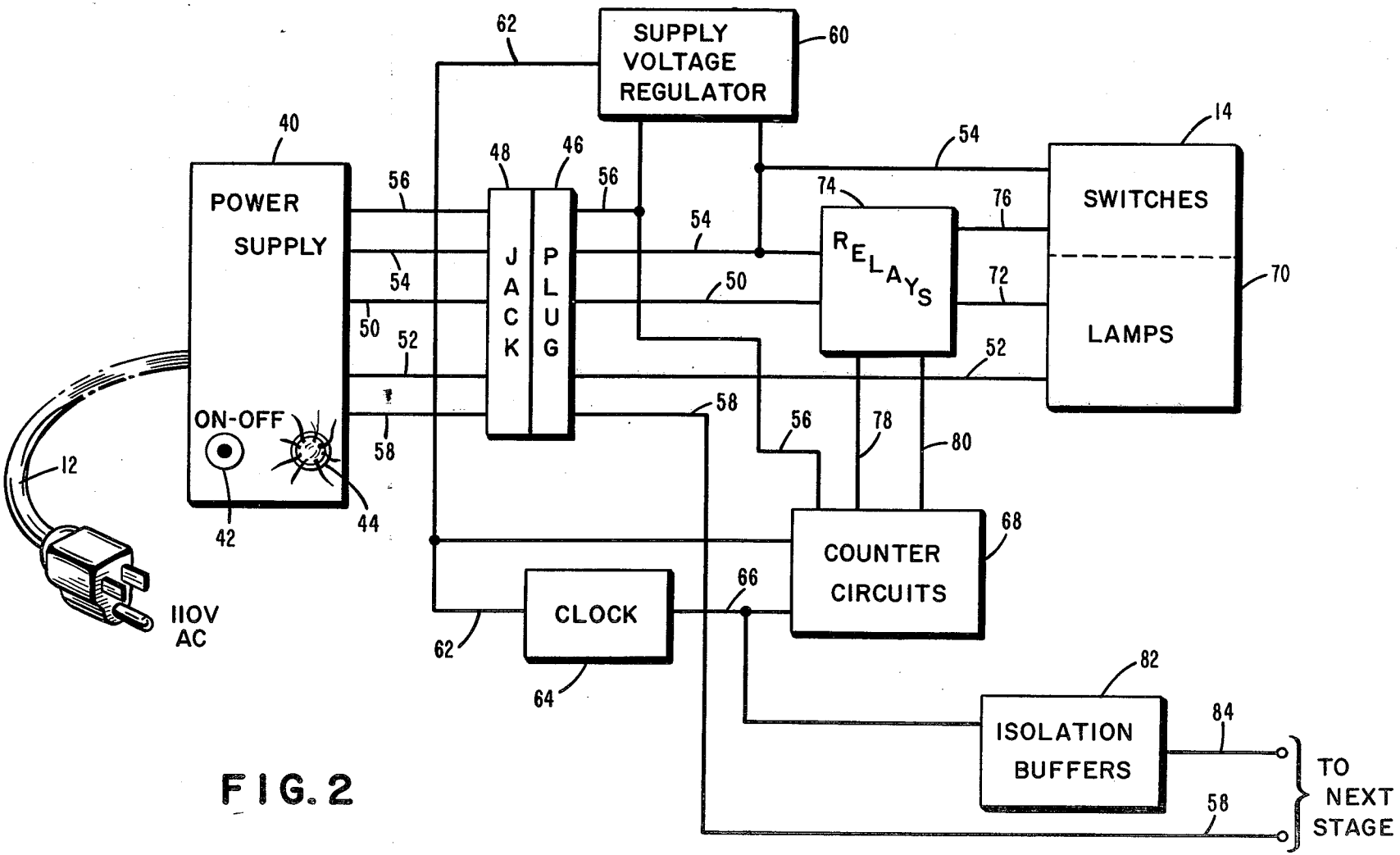
FIG. 2 is a schematic in block diagram form of the circuit of the present invention.

FIG. 2 shows the electronic and electrical elements provided by the present invention in block diagram form. The present invention is intended to operate with conventional household current and, accordingly, the power cord 12 is intended to be plugged into a standard 110 volt, 60 cycle line. The power cord 12 is connected to a power supply 40 which will provide the necessary voltages, which are more readily usable in electronic circuits. The power supply 40 is provided with an on/-off switch 42 and a pilot lamp 44, which indicates that the unit is in operation. Although the power supply and other circuitry will be shown in more detail below, at this time, it is sufficient to note that the power supply provides as outputs to a conventional plug 46 and jack 48 connector an output on lines 50 and 52 which comprises the input AC voltage and on lines 54 and 56, a 24 volt DC voltage. The other output from the power supply 40 on line 58 represents an earth ground connection as provided by a conventional three-pronged electrical plug.

The input AC power on lines 54 and 56 is fed to a supply voltage regulator unit 60 which provides an extremely well-regulated voltage and specifically provides a five volt positive voltage on line 62 which is fed to a clock unit 64. The clock unit 64 produces a pulsed signal on line 66 which is fed to the counter circuits 68 one of which is associated with each individual votive lamp. The counters 68 serve to count the clock pulses on line 66, thereby controlling the period of illumination for the particular lamp.

As seen in FIG. 1, the lamp and switch are formed in a single unit and, accordingly, the lamps 70 are shown associated with the switches 14. The lamps receive suitable energization voltages on line 52 which is one side of the AC line from the power supply and from a connection on line 72 to the relays 74, which is the other side of the AC line. Similarly, the switches 14 are connected to the relays by line 76 and are in the power circuit by means of the connection to line 54 from the power supply. Because a relay and a counter form a unit which is associated with each individual lamp, the relays unit 74 is connected to the counters unit 68 by lines 78 and 80.

As seen in FIG. 1, the present invention is intended to utilize more than one bank of votive lamps and switches, i.e., the array contains additional rows of lamps. Accordingly, the earth ground on line 58 is fed to the succeeding stage and the clock signal on line 66 produced by the clock 64 is fed to an isolation buffer unit 82 of the well-known type, before the clock signal is then fed to the next successive stage on line 84, where it will be fed into a counter unit identical to counter unit 68.

The operation of the inventive electronic votive lights will now be discussed in relation to FIG. 2. After the power supply 40 has been suitably connected and is producing the desired 24 volts DC on lines 54 and 56, the supply voltage regulator 60 will be producing the well-regulated five volts DC. This voltage when fed to the clock 64 causes a low-frequency pulsed signal to be produced on line 66. At this time, the present invention is considered to be in a ready condition or waiting condition, in other words, none of the lamps are illuminated and no timing or counting is taking place, although the low frequency clock signal is available to be counted. The switches 14, which are provided in the present invention, are of the momentary-contact, push-button type and, upon depression of one of such switches, a voltage on line 76 will cause one of the relays 74 to close its normally-open contacts, thereby energizing the coil of the relay and keeping a first normally-open switch closed. This maintains the voltage across the relay coil which was initiated by the momentary-contact, push-button switch 14 and also closes another normally-open contact in the relay, which puts a voltage corresponding to the input AC on line 50 on line 72 which is fed to the lamps 70, thereby energizing the lamp by the voltage appearing across lines 72 and 52. Simultaneously with the illumination of the lamp, one of the counters 68 is energized by the voltage across the relay coil and begins counting the pulsed clock signals on line 66. Upon reaching a predetermined count, the counter, in a manner which will be described in more detail below, will alter the voltage drop appearing across the relay coil, thereby causing the relay to drop out and the normally-open contacts to open and remove the voltage from the specific lamp. It is understood, of course, that each of the switches will, when depressed, energize the appropriate relay which will then cause the appropriate lamp to be illuminated and the counter to begin counting the clock signal from the clock unit. Since the present invention requires only one power supply, one supply voltage regulator, and one clock for producing accurately timed clock pulses, the pulsed signal is isolated by means of the buffers 82 and fed to the next successive stage which also consists of relays, counters, and the plug-in lamp units. These successive units function exactly as the unit described above.

Figure 3:
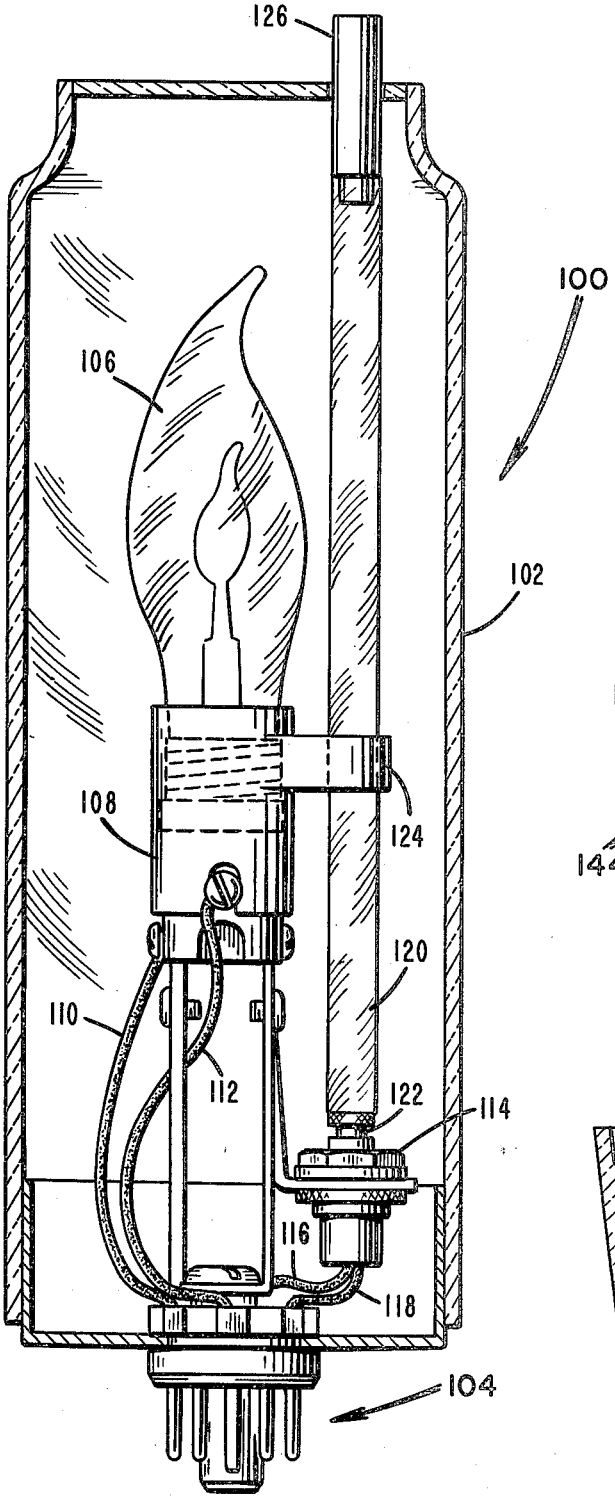
FIG. 3 is a side elevation of one embodiment of an inventive votive lamp unit having a portion of the outer lamp holder cut away.

With reference to FIG. 3, a typical plug in unit 100 is shown in the style traditionally used for a seven day votive candle. In other words, the outer lamp holder 102 is exactly the same configuration as the traditional glass candle holder. In the embodiment, shown in FIG. 3, the outer lamp holder 102 is formed of red transparent plastic, thereby providing an easy manufacturable product while not differing appreciably from the traditional glass votive candle holder. For ease of description, the outer candle holder 102 is shown having a portion cut away.

Each of the individual lamp units 100 is provided with an octal plug assembly 104 which is identical to the conventional octal plug used in vacuum tubes. Located interior to the red transparent plastic holder 102 is a neon lamp 106 which is of a conventional type and which preferably is of the type providing flickering illumination. The lamp is mounted in a socket assembly 108 and is electrically connected to the appropriate pins of the octal plug 104 by wires 110 and 112. Also located interior to the transparent candle holder 102 is a switch 114 which is electrically connected to the appropriate pins of the octal plugs 104 by means of wires 116 and 118. In order to permit ease of actuation of switch 114, an extender rod 120 is provided abutting the contact button 122 of switch 114. The extender rod 120 is slidable retained by a suitable retainer 124 which is affixed to the lamp socket assembly 108. Located at the opposite end of the extender rod 120 is a switch knob 126, which is preferably formed of black plastic so as to be as innocuous as possible.

Figure 4:
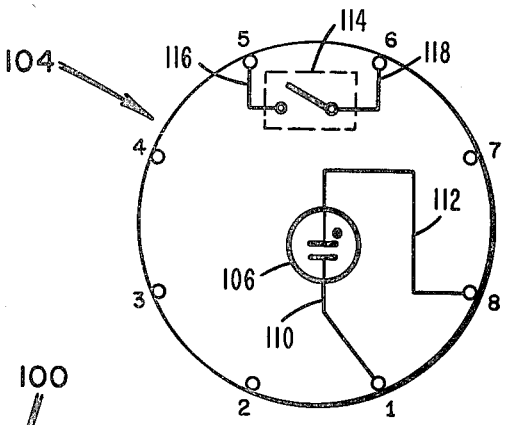
FIG. 4 is a circuit diagram of the switch and lamp wiring of the votive lamp of FIG. 3 in relation to the octal plug.

FIG. 4 shows the electrical connections in schematic form of the inventive votive lamp of FIG. 3. The pins of the octal plug 104 are numbered consecutively from one to eight and the switch 114 is connected to pins 5 and 6 by wires 116 and 118, respectively. Similarly, the neon lamp 106 is shown connected to pins 1 and 8 by conductors 110 and 112, respectively. The manner in which these pins of the plug assembly 104 mate with the electronic timing circuit will be shown in detail in FIG. 7.

Figure 5:
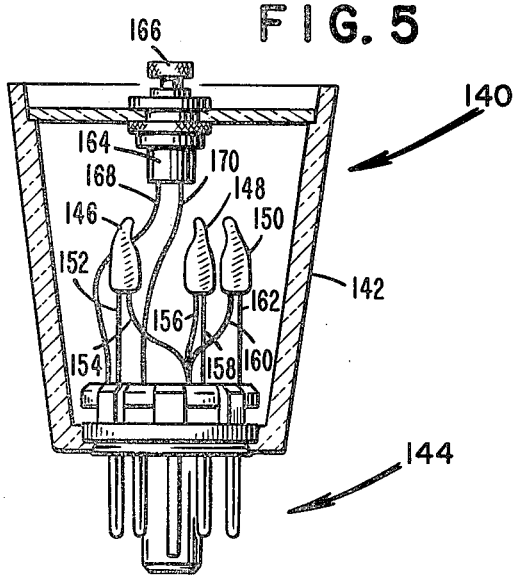
FIG. 5 is a side elevation of another embodiment of a votive lamp having a portion of the lamp holder cut away.

FIG. 5 shows another embodiment of the inventive votive lamp assembly and, more particularly, shows a smaller type unit traditionally utilized for a four hour votive candle. The electric lamps are also mounted inside a traditionally shaped candle holder 142 which is formed of transparent red plastic so as to be identical to the traditional votive photo candle unit. The inventive votive lamp assembly 140 is intended to be plugged into the timing circuit by means of the octal plug 144, which is of conventional configuration. Located interior to the transparent red candle holder 142 are three miniature neon lamps 146, 148, and 150. Lamp 146 is connected to the appropriate pins of the octal plug 144 by wires 152 and 154. Similarly, miniature neon lamp 148 is connected to the appropriate pins of the octal plug 144 by lines 156 and 158, and lamp 150 is connected to the appropriate pins by lines 160 and 162. Also utilized in conjunction with the four hour votive lamp assembly 140, is a switch means 164 which is of the momentary-contact, push-button type. The switch 164 is provided with a suitable actuation knob 166 which protrudes above the top surface of the red transparent candle holder 142 and is also preferably formed of black plastic so as to be relatively innocuous. The switch 164 is connected to the appropriate pins of the octal plug 144 by means of wires 168 and 170.

Figure 6:
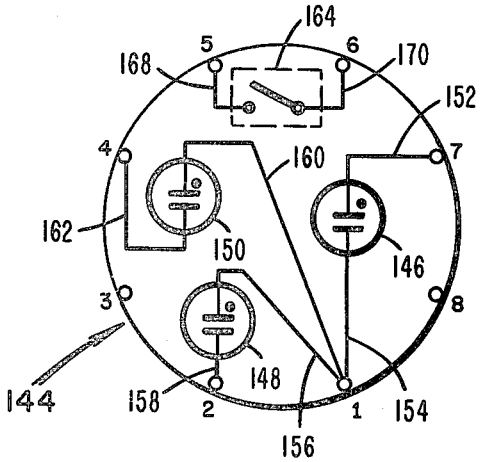
FIG. 6 is a circuit diagram of the wiring of the lamps and switch of the inventive lamp holder of FIG. 5 shown in relation to an octal plug.

FIG. 6 is a schematic circuit diagram showing the manner in which the switch 164 and lamps 146, 148 and 150 are connected to the pins of the octal plug 144. More particularly, switch 164 is connected across pins 5 and 6 of octal plug 144 by means of conductors 168 and 170, respectively. Neon lamps 146 is connected to pins 1 and 7 by conductors 152, 154, respectively, neon lamp 148 is connected to pin 1 and 2 of octal plug 144 by conductors 156, 158 respectively, and neon lamp 150 is connected to pins 1 and 4 by conductors 160 and 162, respectively.

By comparing FIGS. 4 and 6, it is seen that the socket 22 to which the electronic timing circuit of the present invention is connected provides a universal type pin arrangement which will accept either the larger votive lamp of FIG. 3 or the smaller, four hour votive lamp of FIG. 5. More particularly, it is seen that from FIGS. 4 and 6, that the actuating switch is always connected across pins 5 and 6 and similarly, that one side of all of the lamp is connected to pin 1 which is the energization pin. Each lamp is then connected to a different pin in the octal arrangement, and the lamp of FIG. 4 is not connected to any of the pins to which the three lamps of FIG. 5 are connected.

Figure 7A:
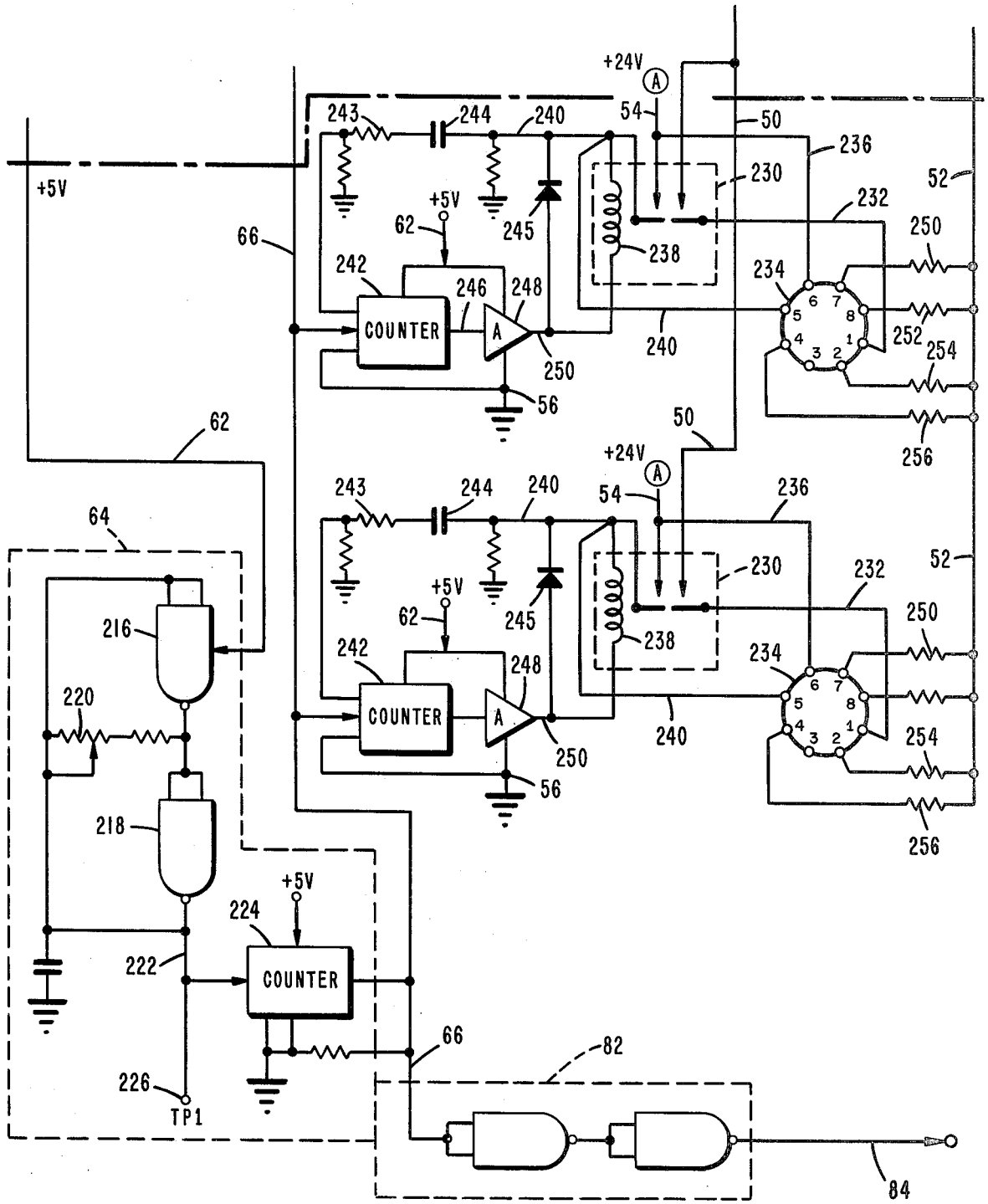
FIG. 7 is a circuit diagram of the electronic timing and energization unit of the present invention.
Figure 7B:
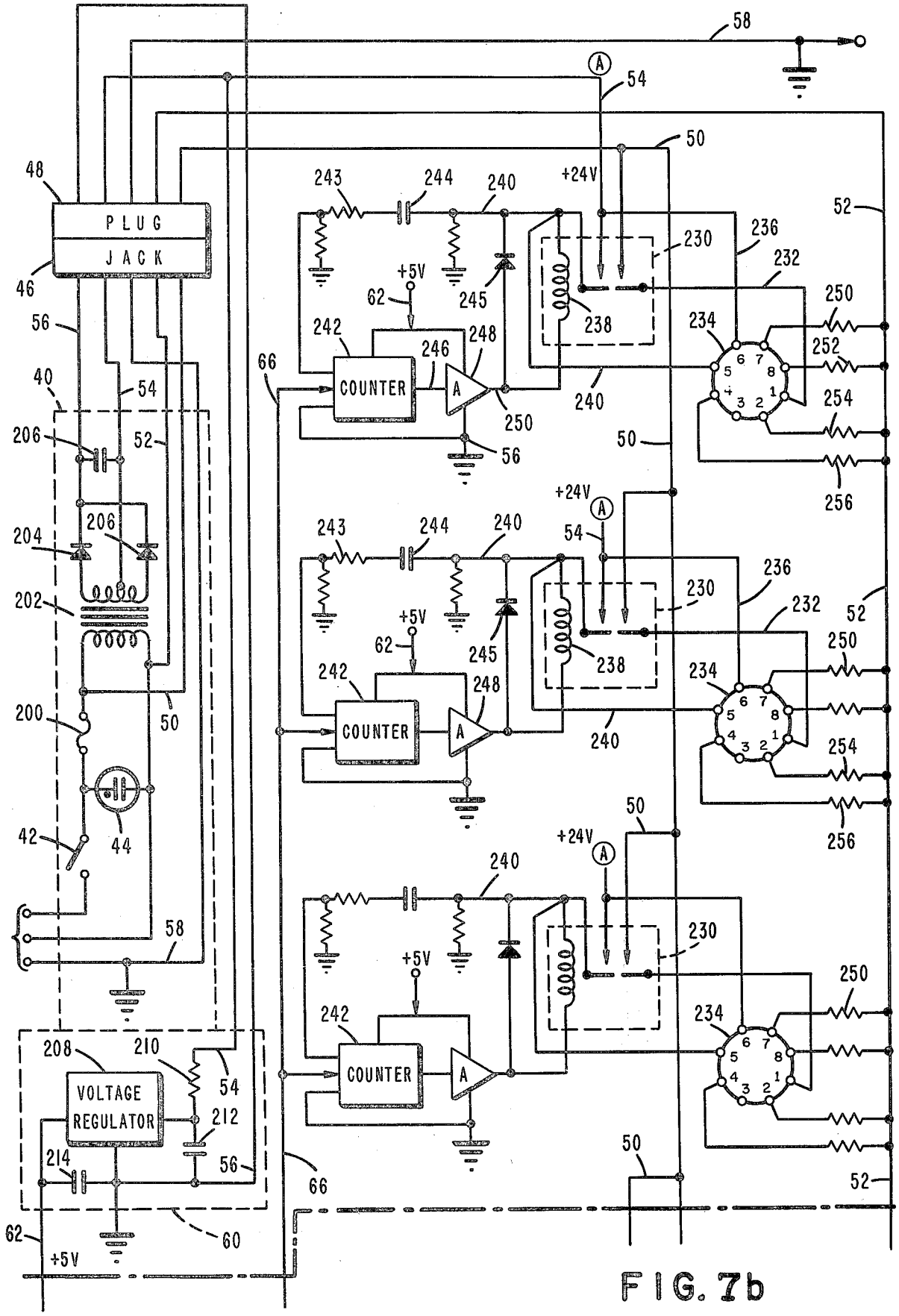

Referring now to FIG. 7, the elements shown in block form in FIG. 2 are set forth in more detail. The 110 volt 60 cycle power is applied to the power supply unit 40 which comprises the on/off switch 42 and the pilot lamp 44 for indicating that the unit is operable. Additionally, a protective fuse 200 is provided. The earth ground appears on line 58 of the conventional three wire input line, which is common to the majority of households. Additionally, prior to having the voltage stepped down by transformer 202, the AC input voltage is fed to the jack 46 on lines 50 and 52, as indicated in FIG. 2. The 110 volt voltage is stepped down by transformer 202 and is then rectified by means of diodes 204 and 206, which are across the secondary of the transformer 202. The secondary of the transformer 202 has a center tap corresponding to line 56 of FIG. 2, which is also fed to the jack 46. The ends of the secondary side of the transformer 204 are tied together by means of diodes 204 and 206 on line 56. A smoothing capacitor 206 is connected across lines 54 and 56, thereby providing a low-ripple DC voltage of approximately 24 volts across lines 54 and 56.

The supply voltage regulator 60, which provides the accurately regulated five volts DC necessary to run the clock unit 64, is connected to lines 54 and 56 and comprises a commercially available voltage regulator integrated circuit 208. A unit suitable for use is manufactured by the National Semiconductor Corp. The 24 volts which appeared across lines 54 and 56 is lowered by a dropping resistor 210, which may comprise a 300 ohm 2 watt resistor. Also used with the integrated circuit voltage regulator 208 are two capacitors 212 and 214, the values of which are determined by the particular integrated circuit utilized. Line 56 is shown as being a ground, however, this ground symbol is intended to mean that the line 56 is an internal ground and is employed as a return line for the 24 volts DC. The earth ground is on line 58.

Accordingly, the five volt positive DC is fed on line 62 to the clock unit 64 which comprises two AND gates 216 and 218 which are connected through a feedback loop in the conventional manner to form an astable multivibrator. Provided in the feedback loop of the astable multivibrator, made up of the AND gates 216 and 218, is a variable resistance potentiometer 220 which may be adjusted to achieve the desired frequency of oscillation. This potentiometer 220 is preferably a twenty-turn potentiometer, so that extremely accurate control over the oscillation frequency is possible. The output of the astable multivibrator on line 222 is fed to a first counter unit 224 which reduces the pulse rate of the astable multivibrator by counting to a certain count before it rolls over or produces an output. Such counters may be called a ripple-carry or a binary counter/divider and, in the present case, the counter 224 employed by the present invention is a 14-stage, ripple-carry unit which counts to the binary number $2^{14}$ and then produces an output pulse. These counters are commercially available as an integrated circuit and manufactured by National Semiconductor Corp. and Texas Instrument Corporation. Accordingly, by adjusting frequency of oscillation and using counter 224, the output from counter 224 on line 66 can be made to be an extremely low frequency signal. Also provided is a test point 226 connected to line 222 to which may be connected a suitable frequency measuring instrument to accurately determine the rate of oscillation of the astable multivibrators. More particularly, by adjusting the twenty-turn potentiometer 220, the frequency at test points 226 should be adjusted to 221.925 Hertz, when it is desired to utilize the plug-in votive lamps corresponding to the seven day candles. Similarly, when it is desired to utilize the smaller four-hour lamps, shown in FIG. 5, the frequency of oscillation at test point 226 should be adjusted by means of the potentiometer 220 to a value of 9320.85 Hertz. Also connected to counter 224 is the highly regulated five volt DC voltage appearing on line 62; however, in the interest of clarity, it is only shown as a five volt bias voltage, rather than connecting it to line 62. Accordingly, as is seen from FIG. 2, a low frequency clock pulse is made available to the counter units 68 on line 66 and hence, this counting signal is available for use by the individual counters, when such counters become activated by means of the relays and switches.

Turning now to the switch and relay portion of the inventive electronic votive lamp circuit of FIG. 7, the input AC signal, which was taken from the input line on lines 50 and 52, is fed through the jack 46 and plug 48 interface to one side of a first relay 230. Accordingly, the contacts on that side of the relay 230 is the 110 volt AC which will be used to energize the proper lamp. This set of contacts of relay 230, as may be seen, are normally open contacts. The other side of the contacts is connected by line 232 to octal socket 234 and, more specifically, to pin number 1 of socket 234. Also provided in relay 230 is another set of normally open contacts, one side of which is connected to the DC voltage of 24 volts which is on line 54 from the power supply, this voltage is also fed to pin 6 of the octal socket 234 on line 236. Relay 230 is then seen to be a conventional relay having two sets of normally-open contacts and having a conventional coil 238 which, when energized, will actuate both sets of normally-open contacts to a closed position.

Connected to one side of the coil by line 240 is a counter unit 242 which comprises an integrated circuit identical to counter 224. The pulsed input to the counter 242 from the clock circuit 64, is always present on line 66 and the counter is always energized by the five volt positive voltage on line 62 from the supply voltage regulator 60. Once the normally-open contacts of relay 230, which carry the 24 volts DC from line 54 are closed, the counter 242 will be reset to zero and will begin to count the pulses on line 66 from an initial zero state. Counter 242 is reset to zero by a reset pulse generated by a resistor 243 and capacitor 244 combination which is energized by the 24 volts DC from the relay 230. Connected across the relay coil 238 is a suppression diode 245 which serves to reduce any transients or surges during energization and deenergization of the coil. Also connected to the top portion of coil 238 on line 240 is pin number 5 of the octal socket 234. The counter 242 then receives the pulsed signal on line 66 and, because the counter 242 is a 14 stage ripple-carry binary counter, it will count to 214 which corresponds to 16,384 and upon reaching such count will produce a high output pulse on line 246. This line 246 is fed to a non- inverting driving amplifier 248, thereby causing such amplifier to produce a higher level output signal or raised voltage output signal on line 250. Also connected to the pins of the octal socket 234 is a first resistor 250 connected to pin 7, a second resistor 252 connected to pin 8 a third resistor 254 connected to pin 2 and a fourth resistor 256 connected to pin 4. The other end of each of these resistors 250, 252, 254, 256 is connected to line 52 from the plug 48 which represents 110 volt AC signal. These resistors then act as dropping resistors for the neon lamps which are connected either in the seven day lamp of FIG. 3 or the four hour lamp of FIG. 5. More specifically, resistors 250, 254 and 256 are utilized in the four hour lamp of FIG. 5 and are all of an equal resistance of approximately 35 K ohms. The seven day lamp of FIG. 3 utilizes one larger bulb and an attendantly lower resistance of 3.6 K ohms at resistor 252. It is, of course, understood that octal socket 234 is intended to receive either octal plug 104 of FIG. 3 or octal plug 144 of FIG. 5. Assuming that a seven day votive lamp of FIG. 3 is inserted into the octal socket 234, the circuit elements in the votive lamp are then connected as shown in FIG. 4.

In operation, the power supply 40 is connected to the proper 110 volt AC source and the on/off switch is closed, thereby providing power to the unit. At the appropriate time, the switch 114 of FIG. 3 is activated by pushing the button 126, thereby closing the normally-open contact switch 114 which, as seen from FIG. 4, is connected across pins 5 and 6 and, attendantly, is now connected across pins 5 and 6 of octal socket 234. By doing this, the 24 volts produced by the power supply is placed on line 240 which is connected to one side of the relay coil 238. The other side of the relay coil is connected by line 250 through the non-inverting amplifier 248 to the internal ground or return line 56, thereby completing the circuit and placing essentially 24 volts across the relay coil 238. Since this is a momentary contact switch, switch 114 immediately opens; however, the voltage remains on the coil since the normally-open relay contacts were pulled in when the coil was energized and will stay pulled in, thereby providing a self-latching relay. At this time, the 24 volts generates a reset pulse through the action of resistor 243 and capacitor 244 which is fed to counter 242, thereby permitting it to begin to count the clock pulses produced on line 66 from the initial zero stage. Similarly, by energizing the relay coil 238, the set of contacts connected to the 110 volt AC line 50 is also pulled in, thereby placing the AC voltage on pin 1 of the octal circuit and, attendantly, at pin 1 of the votive lamp of FIG. 3. As shown in FIG. 4, the neon lamp is connected from pins 1 and 8 and, accordingly, the AC voltage is impressed on the lamp and through resistor 252 to the return line 52. In this manner, the lamp is illuminated. The relay 230 is now still latched, since the path through ground is continued on line 250 through amplifier 248 and during this time, the counter 242 is counting the pulses supplied on line 66. At the time when the last stage of the counter counts the full 16,384 pulses, the counter 242 will produce a high output signal on line 246 which is fed to the non-inverting amplifier 248. The amplifier 248 then produces a raised output signal of approximately 24 volts thereby effectively causing the drop across the relay coil 238 to be zero, hence the relay drops out, thereby opening the contacts of the 24 volt supply and also opening the other set of contacts which is serving to connect the AC line to the lamp. This extinguishes the lamp.

The present invention is intended to utilize a plurality of octal sockets and counters and relay units which may be connected as shown in FIG. 7, i.e., these units are connected in parallel with each other. Each successive unit is identical to the stage described above and in the interest of clarity the 24 volt line is shown at A, as providing the desired voltage necessary to activate the counter. Additionally, since the present invention is intended to provide additional stages which are in series with the overall initial stage shown in FIG. 7, the clock signal on line 66 from the clock unit 64 is passed through an isolation buffer 82, which may comprise two integrated circuit gates or the like. This produces a clock signal on line 84 which has now been buffered for isolation purposes from the initial clock circuit. Also, the system ground is passed to the next stage, as would the power lines corresponding to the 24 volts DC and the 110 volt AC. This may be accomplished by utilizing a properly wired plug and jacket combination to pass the AC and DC signal voltages to the next stage. It is understood, of course, that only one clock unit is required for successive stages and only one voltage regulator and power supply is required.

As a further example of the manner in which the present invention provides either a seven day or four hour votive light, assume that the four hour votive lamp of FIG. 5 has been inserted into the octal socket 234 of FIG. 7. By reference to FIG. 6, it is seen that the momentary contact switch is again across pins 5 and 6 and which can initiate operation as in the above example. In place of the single neon bulb which had been placed across cross-pins 1 and 8, three subminiature neon bulbs are now in the votive candle and are arranged from pin 1 which is energized with the AC signal to pins 2, 4 and 7. Each of these pins has connected between it and the AC return line 52, an identical resistor 250, 254, and 256. Utilization of four hour candles requires that the pulse rate of the signal on line 66 be adjusted, and this is accomplished by placing a suitable frequency measuring instrument at test point 226 and adjusting the potentiometer 220 to produce a pulsed output frequency of 9320.85 Hertz, thereby quickly accelerating the time in which the counter 242 will accumulate the 16,384 counts.

The above embodiment is given by way of example only and it is understood that the present invention is not intended to be limited thereby, since other embodiments are possible. For example, different clock rates and counter capacities are possible and, similarly, different arrangements of neon lamps or incandescent lamps are available for use.

What is claimed is:

1. An electronically controlled electric lamp assembly, comprising:

a plurality of relay means each having energizable coil portions for actuating control contact portions and power contact portions and each relay means being connected to the power source;

a plurality of switch means corresponding to said plurality of relay means, one being electrically connected between one of said plurality of relay means and said electric power source for actuatably energizing said relay coil portions thereby actuating said control contact portions for causing said coil portions to remain energized;

a plurality of electric lamps connected to corresponding power contact portions of said plurality of relay means, whereby upon said energization of said coil portions said power contact portions are actuated and corresponding lamps are energized; and timing means electrically connected to said switch means and said coil portions of said relay means, whereby upon actuation of said switch, said timing means is activated for a predetermined period of time and upon the expiration of said predetermined period of time, said timing means lowers the current flow through said energized coil portions, thereby lowering the voltage drop across said energized coil portions and opening said control contact portions for deenergizing said coil portions and opening said power contact portions of said relay means for deenergizing a corresponding electric lamp.

2. The apparatus of claim 1, wherein said timing means comprises a clock means connected to said power source for producing a pulsed signal, and a plurality of counters corresponding to said plurality of relay means connected to receive said pulsed signal for counting a predetermined number of pulses therein and producing an output signal indicating the expiration of said predetermined period of time.

3. The apparatus of claim 2 wherein said timing means further comprises a plurality of amplifier means connected to receive said counting means output signal and each producing therefrom an amplified signal connected to said coil portions of said plurality of relay means, thereby reducing the voltage drop thereacross and lowering the current flow therethrough and causing said control contact portions and said power contact portions to open.

4. The apparatus of claim 3 further comprising a plurality of light transmitting housings each having mounted therein one of said switch means and a corresponding one of said electric lamps.

5. The apparatus of claim 4 further comprising a plurality of plug means each affixed to one of said light transmitting housings and electrically connected to said switch means and said lamp means for cooperating with a corresponding one of a plurality of socket means, said socket means being electrically connected to said power source and said relay means said coil portion.

6. An electrical light array, comprising:

a plurality of electrical lamps;

a plurality of switch means, one being associated with a corresponding one of said electrical lamps;

a plurality of relay means one being associated with a corresponding one of said switch means and being energizable thereby and each of said relay means being electrically connected to a corresponding one of said electrical lamps;

power source means connected to said relay for supplying power to said plurality of electrical lamps; and timing means connected to said plurality of relay means and energizable for a predetermined period of time, whereby upon actuation of one of said plurality switch means, one of said plurality of relay means closes and energizes one of said plurality of lamps and energizes said timing means for maintaining said lamp in an on condition for said predetermined period of time wherein said timing means comprises a clock means connected to said power source for producing a pulsed output signal, a plurality of counters corresponding to said plurality of relay means, each being connected to receive said pulsed output signal, for producing a counter output signal upon the counting of a predetermined number of pulses, and a corresponding plurality of amplifier means each having an input connected to said counting signal and an output connected to a corresponding one of said relay means such that upon one of said plurality of counters producing said counter output signal, a corresponding one of said plurality of amplifiers produces an amplified output signal for deenergizing a corresponding one of said relay means.

7. The apparatus of claim 7 wherein a one of said switch means and a corresponding one of said electrical lamps are located within a substantially transparent housing, a plug means mounted in said transparent housing and having pins electrically connected to said switch and said lamp, and a socket means electrically connected to said relay means and said power source means for mating with said plug means.

8. An electronically controlled electrical votive lamp assembly for use with a voltage source, comprising:

a plurality of electrical lamps;

a plurality of relay means each of said relay means having a coil portion, a power contact portion, and a control contact portion and each being connected to said voltage source and to a corresponding one of said plurality of electrical lamps for connecting said electrical lamps through said power contact portions to said voltage source;

a plurality of switch means connected to corresponding ones of said relay means and connected to said voltage source for selectively energizing a corresponding one of said coil portions of said relay means thereby closing said control contact portions for causing said coil portions to remain energized and closing said power contact portions whereby an associated one of said lamps is energized; and timing means, connected to said switch means and said relay means for deenergizing said coil portions of said relays upon the elapsing of a predetermined period of time thereby opening said control contacts and disconnecting said coil portions from said voltage source and opening said power contacts and deenergizing said lamps.

9. The votive lamp assembly of claim 8 further comprising a plurality of transparent red plastic housings having one of said plurality of switch means and, one of said plurality of electrical lamp means mounted therein.

* * * * *